United States Patent [19]

Fors

[11] 4,102,458

[45] Jul. 25, 1978

[54] DEVICE IN RACKS FOR SALES PACKAGES AND THE LIKE

[75] Inventor: Henry Fors, Sundbyberg, Sweden

[73] Assignee: Fors & Forss AB, Vallingby, Sweden

[21] Appl. No.: 760,996

[22] Filed: Jan. 21, 1977

[30] Foreign Application Priority Data

Jan. 23, 1976 [SE] Sweden ..... 7600706

[51] Int. Cl.[2] ..... A47F 7/03

[52] U.S. Cl. ..... 211/4; 211/40; 211/49 D; 211/169

[58] Field of Search ..... 211/4, 401, 49 D, 150, 211/153, 169; 221/89, 90, 91; 312/13, 14, 17, 19, 216

[56] References Cited

U.S. PATENT DOCUMENTS

| | | | |
|---|---|---|---|
| 1,127,091 | 2/1915 | Kingman | 312/19 |
| 1,235,380 | 7/1917 | Reese | 312/17 |
| 1,381,525 | 6/1921 | Wagoner | 211/40 |
| 1,557,149 | 10/1925 | Fitzpatrick | 312/17 |
| 1,565,993 | 12/1925 | Fitzpatrick | 312/17 |
| 2,926,788 | 3/1960 | Jacobson | 211/4 |
| 2,976,101 | 3/1961 | Rooney | 211/150 X |
| 3,337,059 | 8/1967 | LeHoy | 211/40 X |
| 3,338,421 | 8/1967 | Lyman | 312/13 X |
| 3,464,748 | 9/1969 | Gregory | 211/40 X |
| 3,478,893 | 11/1969 | Crosslen | 211/169 X |
| 3,638,800 | 2/1972 | Frederick | 211/40 |
| 3,760,952 | 9/1973 | White | 211/4 |

FOREIGN PATENT DOCUMENTS

| | | | |
|---|---|---|---|
| 531,162 | 10/1921 | France | 31 2/13 |
| 1,190,798 | 4/1959 | France | 211/40 |

*Primary Examiner*—Roy D. Frazier
*Assistant Examiner*—Thomas J. Holko
*Attorney, Agent, or Firm*—Wenderoth, Lind & Ponack

[57] ABSTRACT

A rack for goods and/or sales packages of predetermined dimensions includes frames having shelves or spaces for accommodating the goods, these shelves or spaces being of such dimensions and restrictions that the goods can only be inserted and removed in one direction. The novel feature of the disclosure is that that space where the goods can be inserted and removed is provided with a projection which necessitates that the goods be inclined obliquely on insertion and removal. This side is provided with a movable part which in one position prevents, while in the other position permits such oblique inclination. The shelf or space is provided with a support or ridge which, when the movable part is moved to its second, release position, automatically allows the goods to incline, utilising the natural weight of the goods.

7 Claims, 13 Drawing Figures

2
1
1
1
1
1
1
1

6
1
35
20
14
15
17
5
29
4
8
18
19
13
27
26
25
27
26
25
7
35

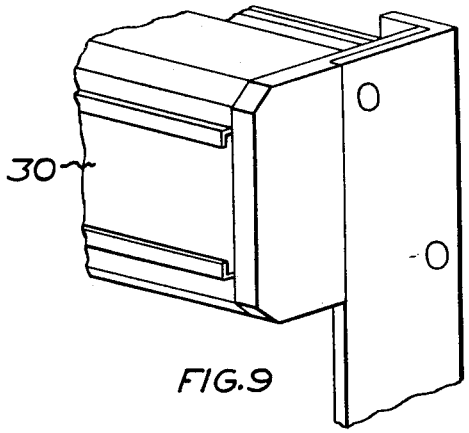
FIG.9
FIG.8
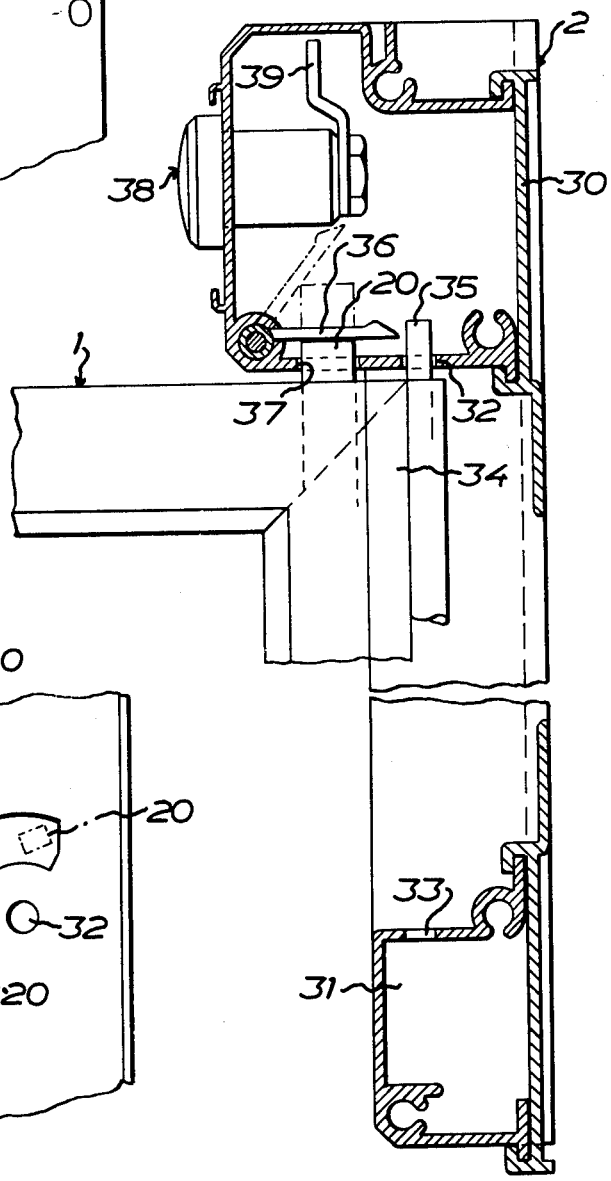
FIG 10
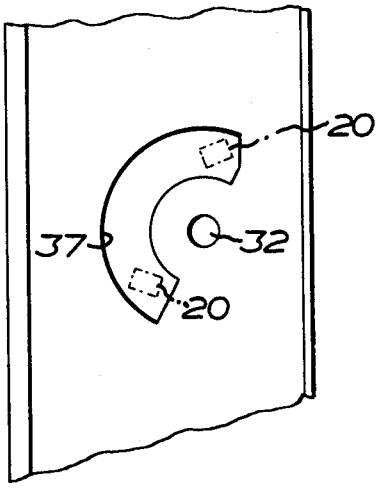

FIG.13
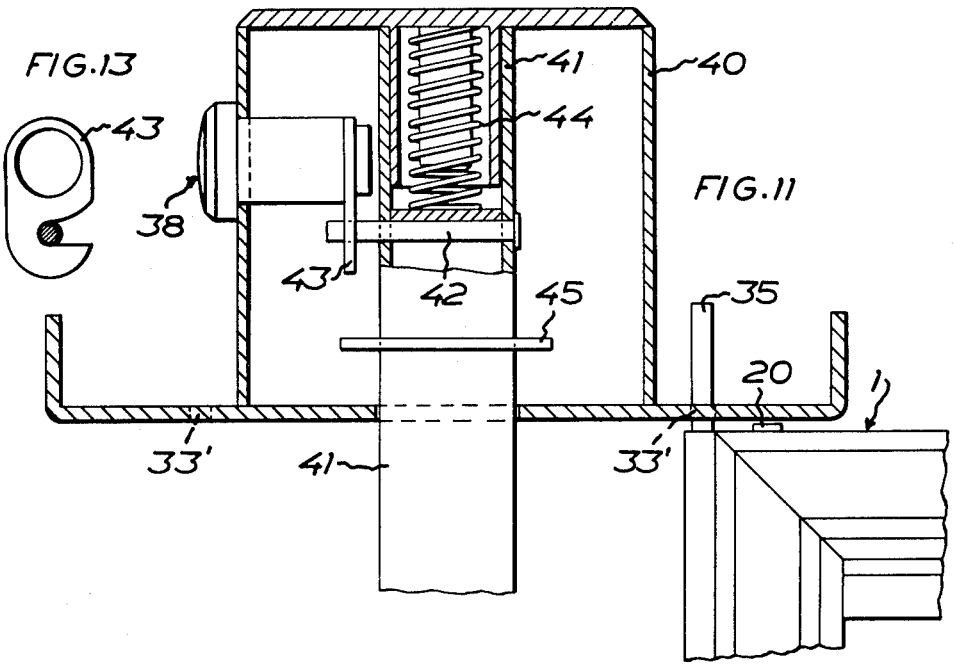
FIG.11
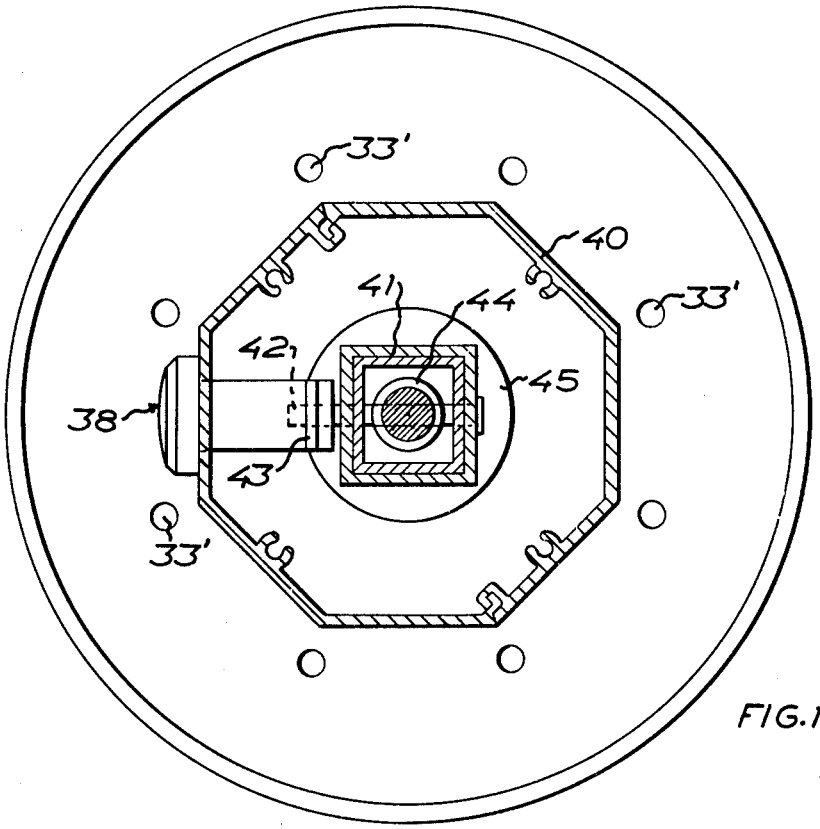
FIG.12

DEVICE IN RACKS FOR SALES PACKAGES AND THE LIKE

BACKGROUND AND SUMMARY OF THE INVENTION

The present invention relates to a device in racks for goods and/or sales packages or the like of substantially parallelepipedic shape, comprising at least one shelf space of a depth which substantially corresponds to the depth of the goods, and a free height which closely approximates the height of the goods. Moreover, the shelf space, which is provided at its ends and at its rear with portions preventing the removal of the goods from the space sideways and/or backwardly, is defined at the bottom by a shelf and at the top by a portion preventing upward shifting of the goods in the shelf space.

Sales and display racks are known in many forms. For goods which are, despite their small size per unit, of a relatively high cost, attempts have long been made to find a solution to the problem of displaying the goods in an attractive manner and simultaneously preventing unauthorized removal of them. The prior art constructions are complex and may possess shortcomings both as regards handling and function. The object of the present invention is to provide a rack which satisfies high requirements as regards display, function and handling. The essential characterizing feature of the device according to the invention is that a projection rising above the plane of the shelf is provided along the front edge of the shelf; that the distance between this projection and the surface restricting the shelf space at the top is less than the height of the goods; that a ridge is provided adjacent the rear edge of the shelf and forms the sole vertical support for goods placed in the shelf space; and that an adjustable abutment extending transversely of the shelf space is shiftable between an inner position in which it is located above substantially in the same vertical plane as the projection at the front edge of the shelf, and an outer position in which it is located a distance from the above-mentioned plane outside the shelf space. Goods placed in the shelf space which rest against the ridge and are supported in an outward direction at their lower edge by the projection are kept, by force of gravity, bearing against the movable abutment which, in its inner position in cooperation with the portions restricting the shelf space, prevents the removal of the goods from the space and, in its outer position, permits the removal of the outwardly projecting goods with its upper portion outside the surface restricting the shelf space at the top.

BRIEF DESCRIPTION OF THE DRAWINGS

The nature of the present invention and its objects will be more fully understood from the following description of the drawings, and discussion relating thereto.

In the accompanying drawings:

FIG. 8 is a vertical section of a wall mounting;

FIG. 9 is a perspective view of one end portion of the upper section of the wall mounting;

FIG. 10 shows a detail of the underside of the upper section of the wall mounting;

FIG. 11 is a vertical section of the upper mounting for a so-called "roundabout" rack;

FIG. 12 is a horizontal section through the same mounting; and

FIG. 13 shows a locking arm included in the lock.

DETAILED DESCRIPTION OF THE INVENTION

Figure 1:
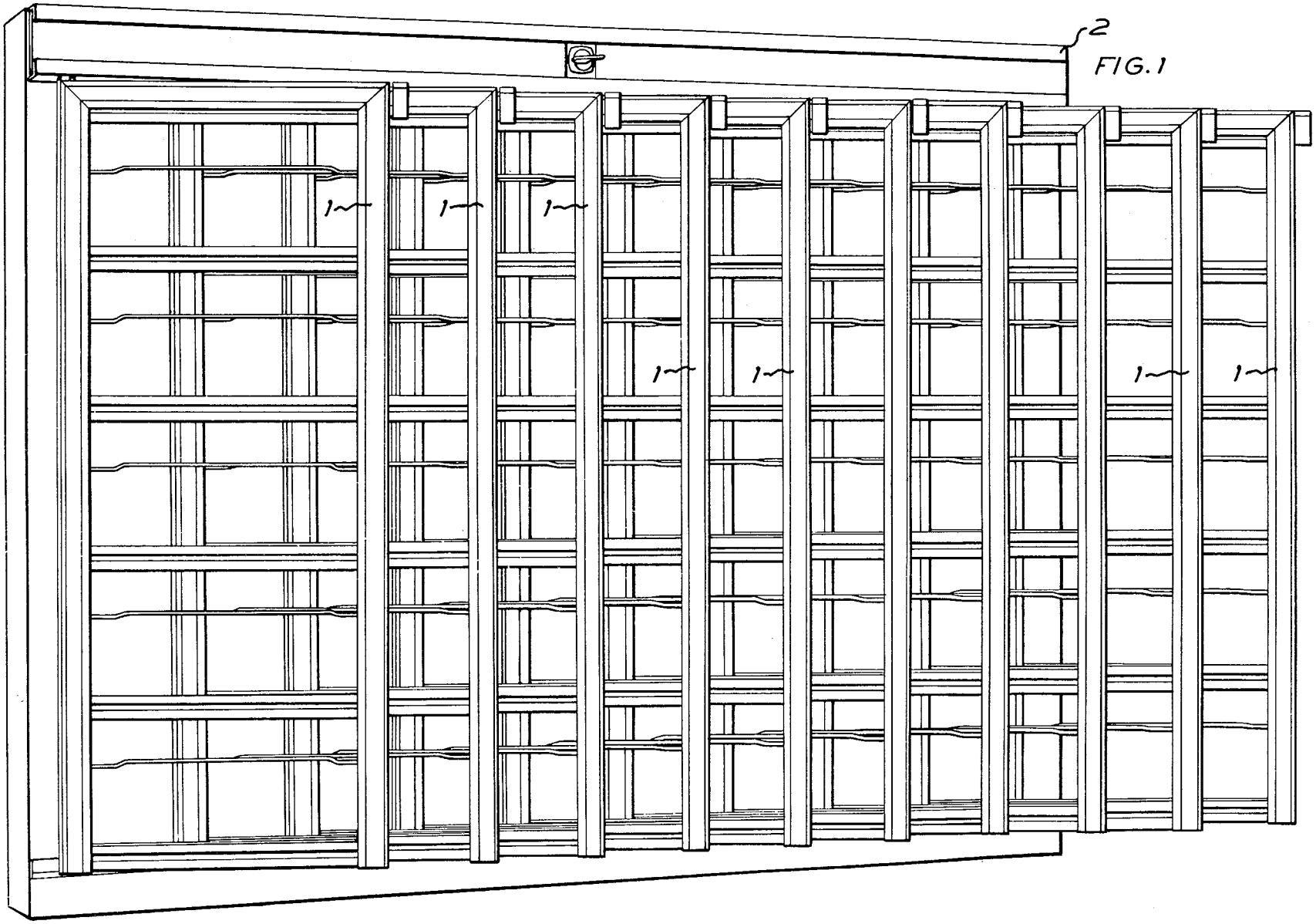
FIG. 1 shows an embodiment of the invention intended for mounting to a wall or the like and being particularly adapted for tape cassettes.

A rack consists of a number of frames 1 provided with shelves and intended for supporting goods, the frames being supported on their intended stands. The stands may consist of a straight rail device 2 which can be mounted on a wall (FIG. 1) or a socalled column mounting 3 (FIG. 2). In both cases, the frames 1 can be pivoted in one or the other direction.

Each one of the frames 1 consists of an inner and outer side-piece 4 and 5, respectively, and a top and bottom piece 6 and 7, respectively. The desired number of shelves 8 is mounted between the side-pieces 4 and 5, the goods (in this case the cassettes) being intended to be placed between these side-pieces and the top and bottom pieces 4, 5, 6 and 7. The shelves 8 and the bottom piece 7 are provided, on their upper sides with two upwardly projecting flanges or projections 9 and 10, respectively. Shelves 8 and the top piece 6 each have a flange 11 on the underside thereof. The vertical distance between the shelves is such that a goods box can be inserted into the space between the shelves, or between the bottom piece 7 and the lowermost shelf, in such a manner that the lower edge portion of the box is inserted between the flanges 9 and 10 and its upper edge portion is pivoted under the superjacent shelf, or under the top piece 6. On the other hand, the distance between the opposing flanges 9 and 11 is less than the height of the goods.

Figure 4:
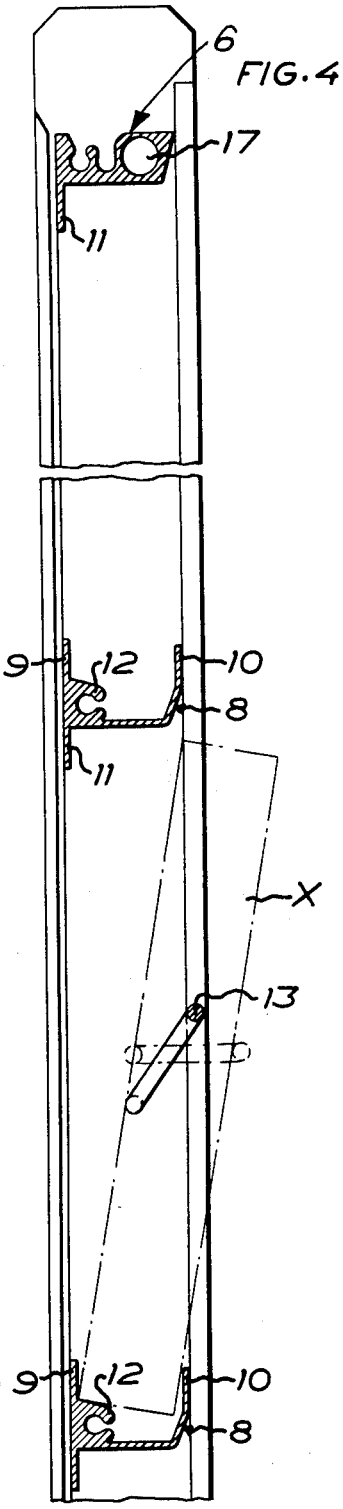
FIG. 4 is a vertical section of the frame of FIG. 3.

As is apparent from FIG. 4, the bottom portion of each shelf, and the bottom portion of bottom piece 7, between the flanges 9 and 10 thereof is provided with a ridge 12 disposed along the rear edge. The ridge is of such transverse extent and shape that a box resting against the ridge and placed against the depending flange 11 of the superjacent shelf will, as soon as it is released, automatically pivot away from the flange 11 and swing outwardly.

Figure 3:
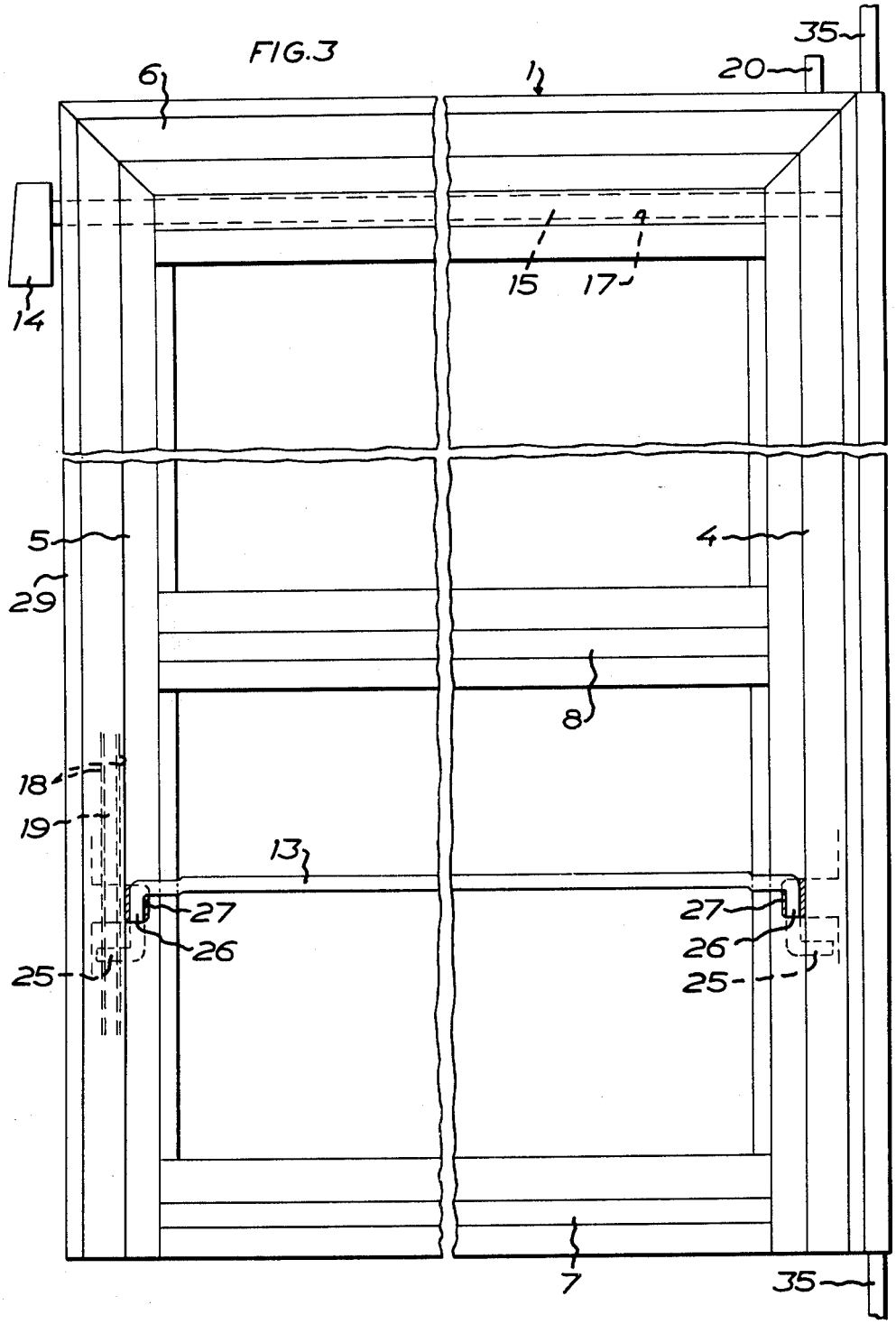
FIG. 3 is, on a larger scale, a front elevation of the frames included in the rack.
Figure 5:
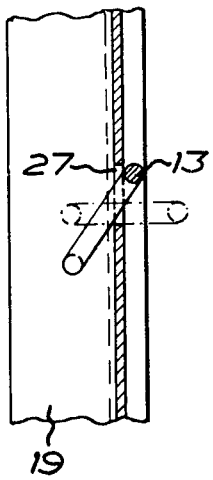
FIG. 5 shows a detail of FIG. 4 and illustrates the movement of the locking bar member.

As is most clearly apparent from FIG. 3, 4 and 5, a shiftable abutment in the form of a bar member 13 is provided for, in shelves. Each bar member is shiftable from a first position, retaining the box in a position parallel with the frame and, to a second position, allowing the box to pivot forwardly for making possible the removal or insertion of boxes. FIG. 4 illustrates, by means of broken lines, how a box X will automatically assume an outwardly sloping position which permits removal of the box obliquely upwardly when the bar member 13 is outwardly pivoted to its second position.

Operation of all of the locking bar members 13 on one frame 1 is effected centrally by means of a handle 14 disposed at the outer upper corner of the frame 1. The handle 14 is fixed to a square shaft 15 which is mounted in a groove 17 running along the top piece 6.

Figure 6:
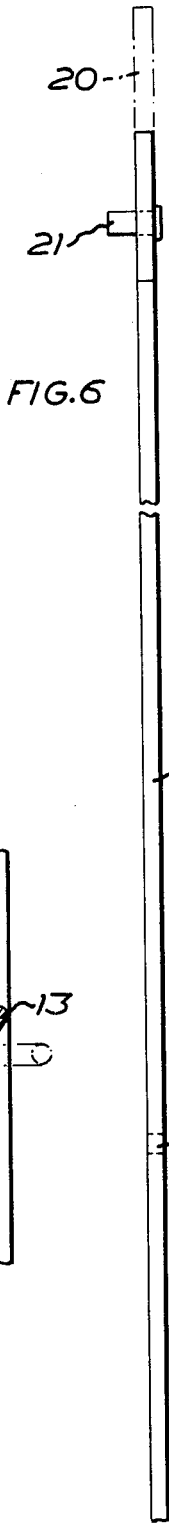
FIG. 6 is a front elevation of a locking rail included in the frame.
Figure 7:
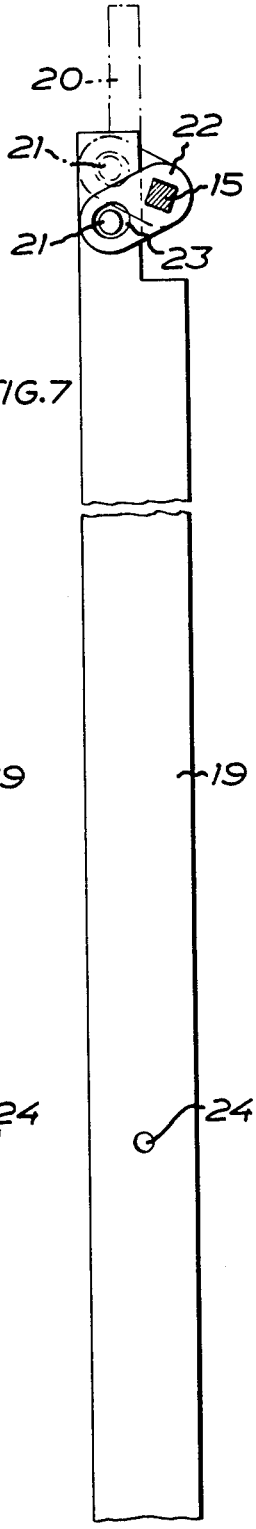
FIG. 7 shows the same rail from the side.

A guide 18 for a rod 19 is disposed in each respective side-piece 4 and 5 between inner and outer strips which may suitably be snapped together. Only the rod located in the outer side-piece 5 is shown on the drawings. A similar rod is to be found in the inner side-piece 4, this rod being moreover extended in the top thereof by means of a projection or stud member 20 (shown by broken lines in FIG. 6 and 7). This projection will be discussed later. A pin 21 is fixed to each rod 19, the pin being connected to an arm 22 which is rigidly connected to the shaft 15 operable by means of the handle 14. In order to ensure smooth movement between the position shown in FIG. 7 by solid lines and the position shown therein by means of broken lines, the hole 23 in the arm 22, in which the pin 21 is inserted, is elongated.

Furthermore, there is provided, in each rod 19, a number of holes 24, corresponding to the number of shelves and bar members 13, through which holes 24 the bent end portions 25 of the bar members 13 extend.

The transversely bent end portions 26 of the bar members are, on mounting of the frame, inserted through holes 27 in the front sides of the hollow frame side-pieces 4 and 5. Moreover, the rods 19 are forced onto the end prongs 25 of the bar members before outer, substantially U-shaped, strips 29 of the frame side-pieces are snapped together.

The holes 27 serve as guides for the portions 26 of the bar members 13. When the arms 22, by turning of the handle 14, are turned, the rods 19 will be lifted or lowered. Since the portions 26 of the bar members 13 will, as is most clearly apparent from FIG. 5, slide towards and be guided by the edges of the holes 27, the longitudinal center portion of the bar members 13 forming a support abutment for boxes placed in the shelves will effect an outward/downward or upward/inward movement. Because the boxes bear against the ridge 12 only at the distal edge of the bottom of the shelves 8, the natural weight of the boxes will cause the boxes to follow the movements of the bar members 13. Thus, when the rods 19 are lifted, the boxes will pivot forwardly to the position shown in FIG. 4 by means of broken lines; and, when the rods are lowered, the boxes will pivot inwardly so as to come into a plane with the frame 1 and the forward edges of the shelves.

Figure 2:
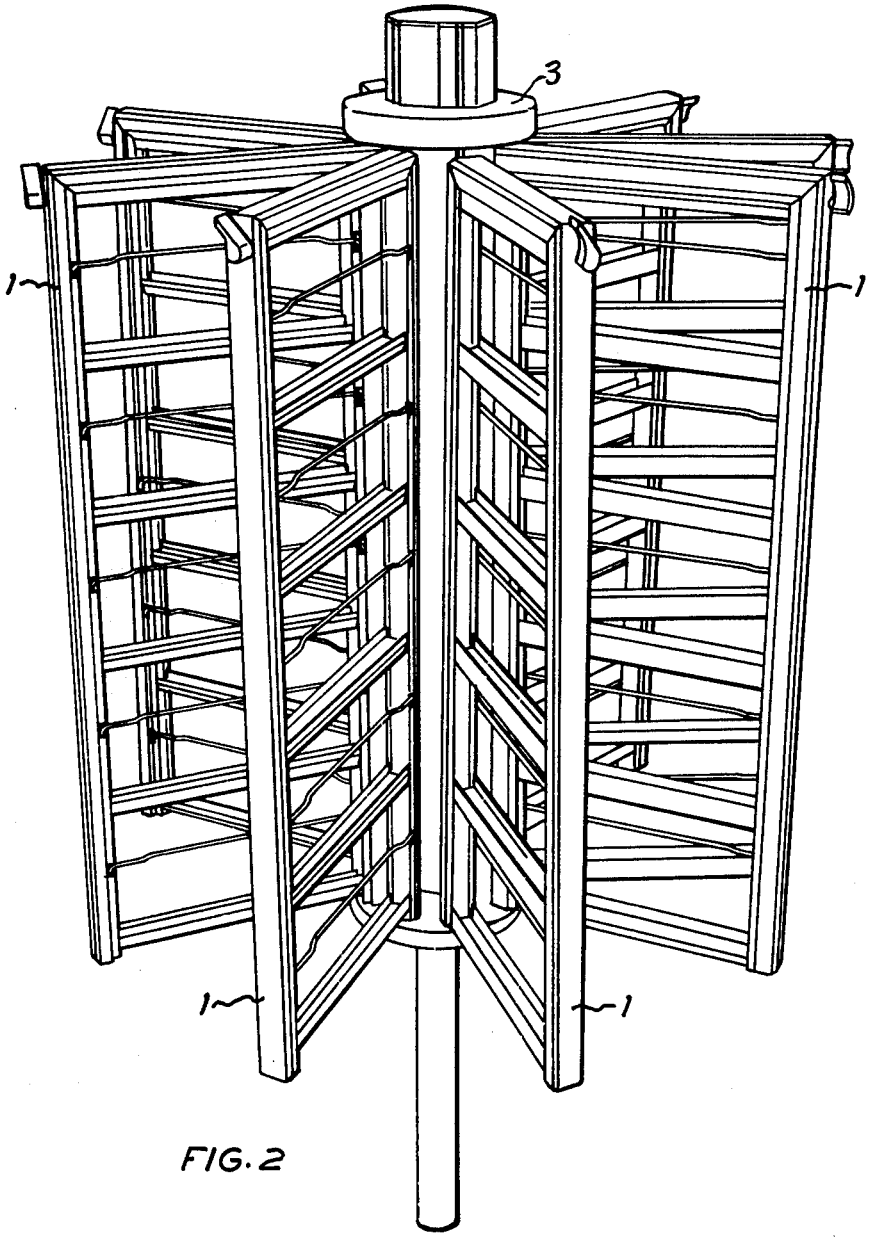
FIG. 2 shows an embodiment intended for similar purposes supported on a column.

As is apparent from FIGS. 1 and 2, the frames 1 form a complete rack together with the stands. In FIGS. 8 and 9 is shown a straight stand which may serve as a wall mounting 2 and consists of an upper portion 30 and a lower portion 31 which in turn are fixed to rails. Journal holes 32, 33 are provided in both the upper portion and the lower portion for shafts 35 disposed in guides 34 at the inner side-piece 4 of each of the frames 1. In order that the frames 1 be able to assume a determined position, that is to say, that they may either be pivoted inwardly in one direction towards the wall supporting the mounting 2 or pivoted outwardly therefrom, the holes 32 and 33 are mutually offset so that the vertical line from the upper hole 32 will strike a point located by the side of and outside the lower hole 33.

Mention has previously been made of the fact that the rods 19 acting upon the bar members 13 are provided, at the inner edge of the frames, with a projection 20. This projection follows the movement of the rods 19 and, hence, as is apparent, for example, from FIG. 3, extends above the upper edge of the frame when the locking bar members are in the open position.

A movable locking flap 36 is disposed at the upper portion 30 of the wall mounting and forms a locking mechanism together with the above-mentioned rod projection 20. As is apparent from FIG. 10, an arcuate slot 37 is provided in the upper portion 30 of the wall mounting adjacent each journal hole 32. When the bar members 13 are in the open position the rod projections 20 can project through these slots without preventing the pivoting movement of the frames 1. The locking flap 36 is journalled at one edge thereof and is quite simply lifted up by the projections 20 when the projections project up through the slits 37. If the rack is to be locked, a key inserted in a lock 38 can be turned, thereby turning a locking arm 39 so that the locking flap 36 is pivoted downwardly, whereupon it will depress the upwardly projecting projections 20 which act upon the bar members 13 and lock the rack. Naturally, it is also possible first to see to it that all of the handles 14 are in the closing position and thereafter lock the locking flap 36 by means of the key. In the lowered position, the locking flap prevents upward shifting of the rods 19 and thereby pivoting of the bar members 13 to open position.

In the embodiment according to FIGS. 11 and 12, this embodiment being intended for use with so-called "roundabout" stands or columns there is also provided an upper and lower portion provided with journal holes for the shafts 35 of the frames. Only the upper portion 40 provided with the journal holes 33' is shown on the drawing. The lower portion consists of a disk fixedly mounted to the stand column 41 and provided with similar holes.

In the embodiment according to FIGS. 11 and 12, the upper portion 40 is supported by and shiftable relative to the column 41. The cap-like upper portion 40 surrounds a locking arm 43 which cooperates with a pin 42 fixed to the column 41 and is actuable by means of a key. In the locked position the portion 40 assumes the position shown on the drawing and when the lock is released, the portion 40 is shifted by means of the spring 44 upwardly until its bottom (provided with the journal holes 33') engages with a fixed abutment 45.

In the locked, downwardly shifted position, the distance between the underside of the portion 40 and the upper edge of the frames 1 is so small that the rods 19 with the projections 20 cannot be shifted upwardly to release the bar members 13. When, on the other hand, the portion 40 has been shifted upwardly (the journal holes 33' being shifted along the shafts 35), the distance is so large that the rod projections 20 can easily be shifted upwardly and the locking bar members 13 of the frames 1 can be opened.

It is obvious that several modifications are possible as regards the design of the locking bar members, the mechanism for their operation and the central locking mechanism. It is also obvious that the frames included in the rack may be provided in many different variations both as regards shelf division and dimensional proportions. This disclosure relates only to one field of use but it is obvious that the rack according to the invention may be used within many fields in conjunction with types of goods for which use is made of boxes or packages of a suitable type.

The invention should not be considered as restricted to that described above and shown on the drawings, many modifications being possible within the spirit and scope of the appended claims.

What we claim and desire to secure by Letters Patent is:

1. A rack for supporting and displaying at least one article of goods and/or sales package of the type having predetermined dimensions and having a generally flat bottom face, said rack comprising:

at least one shelf space having a depth dimensioned to substantially correspond to the depth dimension of an article to be positioned in said shelf space and having a free height which approximates the height of an article to be positioned in said shelf space;

means provided at the back and opposite ends of said shelf space for preventing the rearward and sideways removal of an article positioned therein;

top means provided at the top of said shelf space for preventing the upward movement of an article positioned therein;

an immovably positioned shelf member defining the bottom of said shelf space;

an immovable projection extending upwardly from the front edge of said shelf member, the upper edge of said projection being spaced from said top means to define a vertical opening therebetween of a dimension less than the height of an article to be positioned in said shelf space;

ridge means, extending upwardly from the back edge of said shelf member, for providing the sole support for an article positioned in said shelf space by engaging such article along the rear edge of the flat bottom face thereof and for allowing such article to tend to swing by gravity about such rear edge toward said vertical opening; and a shiftable abutment means extending transversely of said shelf space at a position above said shelf member, said abutment means being movable between an inner first position vertically above said projection and an outer second position spaced from said shelf space, such that when an article is positioned within said shelf space with the rear edge of the flat bottom face of the article resting on said ridge means and when said abutment means is in said inner first position, the article is maintained entirely within and is prevented from being removed from said shelf space by said abutment means, and such that when said abutment means is in said outer second position, the article is allowed to swing by gravity about the rear edge so that the upper end of the article extends through the vertical opening and the article can be removed therefrom.

2. A rack as claimed in claim 1, comprising a frame having therein a plurality of vertically spaced said shelf spaces, each said shelf space having associated therewith a separate said ridge means and a separate said abutment means, and further comprising means supported by said frame and connected to all of said abutment means for simultaneously controlling the movement of said abutment means.

3. A rack as claimed in claim 2, wherein each said abutment means comprises a bar member extending across the respective said vertical opening.

4. A rack as claimed in claim 3, wherein each said bar member has extending inwardly from opposite ends thereof integral extensions, said extensions having extending laterally therefrom integral pivots, said frame having opposite sidepieces extending along opposite sides of said shelf spaces, each said side-piece having therein a vertically movable rod, said extensions extending through guide holes in said side-pieces, and said pivots being coupled to said rods.

5. A rack as claimed in claim 4, further comprising a shaft extending through the top of said frame, and a pair of levers fixed to opposite ends of said shaft, each said lever being pivoted to a respective one of said rods.

6. A rack as claimed in claim 4, wherein at least one of said rods has extending upwardly from the top thereof a stud member adapted to extend through and above said frame for cooperation with an external locking mechanism.

7. A rack as claimed in claim 6, comprising a plurality of said frames each pivoted about one side-piece thereof to a support member, each said frame having extending therefrom a stud member, all of said stud members being adapted for cooperation with an external locking mechanism.

* * * * *